US006105655A

United States Patent [19]

Judkins

[11] Patent Number: 6,105,655

[45] **Date of Patent: *Aug. 22, 2000**

[54] HIDDEN HOLE VENETIAN TYPE BLIND

[76] Inventor: Ren Judkins, 46 Newgate Rd., Pittsburgh, Pa. 15202

[ * ] Notice: This patent is subject to a terminal disclaimer.

[21] Appl. No.: 08/972,132

[22] Filed: Nov. 17, 1997

Related U.S. Application Data

[63] Continuation-in-part of application No. 08/972,852, Nov. 18, 1997, which is a continuation of application No. 08/661,192, Jun. 10, 1996, Pat. No. 5,692,532, which is a continuation of application No. 08/384,136, Feb. 6, 1995, Pat. No. 5,573,051.

[51] Int. Cl.[7] ..... E06B 9/30

[52] U.S. Cl. ..... 160/168.1 R; 160/176.1 R

[58] Field of Search ..... 160/168.1 R, 170 R, 160/171 R, 172 R, 173 R, 176.1 R, 177 R, 178.1 R

[56] References Cited

U.S. PATENT DOCUMENTS

| | | | |
|---|---|---|---|
| 2,421,505 | 6/1947 | Hunter | 160/173 R |
| 3,189,081 | 6/1965 | Lorentzen et al. | 160/173 R |
| 3,460,601 | 8/1969 | Abraham | 160/168.1 R |
| 5,060,709 | 10/1991 | Simon | 160/176.1 R X |
| 5,375,642 | 12/1994 | Gaber et al. | 160/168.1 R |
| 5,386,867 | 2/1995 | Chen | 160/168.1 R |
| 5,409,050 | 4/1995 | Hong | 160/168.1 R |
| 5,573,051 | 11/1996 | Judkins | 160/168.1 R |
| 5,657,806 | 8/1997 | Hung | 160/168.1 R |

*Primary Examiner*—David M. Purol
*Attorney, Agent, or Firm*—Buchanan Ingersoll, P.C.

[57] ABSTRACT

An improved venetian type blind has slats having at least one small hole adjacent one edge of each slat. At least two ladders having opposing cord type rails and rungs extending therebetween carry slats and are connected to the bottomrail. A first lift cord runs through the holes and adjacent to the first ladder. A second lift cord runs across the opposite edge of each slat adjacent the rail of a second ladder. A similar arrangement can be provided using pairs of spaced apart holes and two pairs of lift cords. A tilt mechanism attached to the headrail moves the oppositely disposed lift cords and the rails of the ladders together when the blind is changed from an open to closed position.

27 Claims, 13 Drawing Sheets

81
82
13
12
13
6
100
11
100
6
100
5
40
4

84
83
13
12
13
6
100
102
100
102
6
6
11
100
102
5
40
4

85
85
13
12
13
6
100
11
100
6
100
89
85
88
4

HIDDEN HOLE VENETIAN TYPE BLIND

CROSS REFERENCE TO RELATED APPLICATION

This is a continuation in part of U.S. patent application Ser. No. 08/972,852, filed Nov. 18, 1997, which is a continuation of U.S. patent application Ser. No. 08/661,192, filed Jun. 10, 1996, and issued Dec. 2, 1997, as U.S. Letters Pat. No. 5,692,532, which is a continuation of U.S. patent application Ser. No. 08/384,136, filed Feb. 6, 1995, and issued Nov. 12, 1996, as U.S. Pat. No. 5,573,051.

FIELD OF INVENTION

The invention relates generally to a venetian type blind, and more particularly to a venetian type blind having slats in which only a single hole for a lift cord is provided near one edge of the slats such that when the slats are rotated closed the opposite edge of each slat covers the hole in an adjacent slat so no light can pass through the slats.

BACKGROUND OF THE INVENTION

Venetian type blinds have a series of slats hung on ladders which extend from a headrail to a bottomrail. Depending upon the width of the blind, two or more lift cords are provided. Usually, each lift cord is attached at one end to the bottomrails. The lift cords pass through elongated holes in the slats up to and through the headrail. A cord lock is usually provided in the headrail through which the lift cords pass. The cord lock allows the user to maintain the blind in any desired position from fully raised to fully lowered.

The slats rest on rungs between rails of the ladders. The blind is in an open position when the rungs are horizontal. To close most venetian blinds one lifts one rail while allowing the other rail to either remain in place or be lowered. This raises one end of each rung tilting the slats. Thus, when the blind is closed there is typically tension on one rail while the other rail of the ladder is not in tension.

The rails originally used for venetian blinds consisted of a fabric tape typically from one to two inches in width. The rungs were also made of fabric strips. Conventionally, the lift cords pass through holes in the slats which were aligned between the rails of the ladder. When the blind was closed, the fabric rails covered the holes. Consequently, there was no concern about light passing through the holes when the blind was in a closed position.

Walker in U.S. Pat. No. 2,572,224 discloses slats for a venetian type blind having a tape type ladder system and two lift cords. One lift cord passes through notches on the inside edges at one end of the slats. The second lift cord passes through notches on the outside edge of the other end of the slats. Each lift cord is positioned behind one of the tape-type ladders. Walker does not disclose any lift mechanism inferring that a standard lift mechanism could be used. In a blind made with Walker's slats the lift cords play no role in maintaining the slats in alignment when the blinds are closed. Rather, the tape-type rails of the ladders maintain the slats in alignment.

Very few tape type ladders are used in blinds today. Rather, the art has adopted ladders formed of cord rails having cord-type rungs between them. Typically, the rungs are multiple strands of cord. However, a single strand of cord has also been used. Frequently, a braided cord is used for the ladder rails. In nearly all venetian type blinds, the conventional lift cord arrangement in which the lift cord passes through elongated holes in the center of the slats is used. The lift cords are aligned to be between the rails of the ladders which are provided near opposite ends of the blind. When this type of blind is closed light can pass through the holes in the blind slats. This is readily apparent to anyone looking at the closed blind.

In pleated shades efforts have been made to prevent light from passing through the cord holes by making the holes to be a diameter very close to the diameter of the cord. This is not possible in a venetian type blind where the holes must be elongated to allow the slats to tilt properly.

In the venetian blinds which utilize a cord-type ladder the blinds are opened and closed by lifting or lowering one of the ladder rails relative to the other. In most blinds the lateral position of the ladder rails relative to one another remains unchanged at the headrail. Thus, there will be slack at the top of one of the ladder rails and the center of gravity shifts forward or back when the blind is tilted.

In my U.S. Pat. No. 5,573,051, I provide a venetian type blind having slats that are notched to form slots on their inside edge and outside edge to accommodate the lift cords. The lift cords pass from the bottomrail to the headrail each passing through a slot on the inside edge or outside edge of each slat. At least two cord-type ladders are provided to hold the slats and are aligned such that the rails of the ladders are adjacent the lift cords and outside the slots cut in the slats. At least two front slots are provided on the front edge of each slat and a corresponding set of rear slots are cut into the back edge of each slat opposite the front slots. The slots are sized so that the lift cords and the ends of the rungs can loosely fit therein. Because lift cords travel within the slots provided in the slats no cord holes are needed in the slats. Since there are no holes in the slats and the slots overlap the slats, light is effectively prevented from passing through the blind when the slats are rotated to a closed position. However, the slats in this blind can flip over which is not desired, particularly if curved slats are used.

Recently, Hunter Douglas introduced a venetian blind wherein the lift cord holes are punched close to the back edge of each slat. A single lift cord passes through each hole. Since the cord holes are off-center and the slats are curved transversely, the slats will close tightly only when tilted in a direction where the holes are on the upper edge of the titled slat. If tilted so that the cord holes are on the lower edge of the slat the edges of the curved slats hit the cord allowing a noticeable amount of light to pass through the blind when the slats are closed. Unlike the usual case where the holes are centered, in a blind having cord holes in the back edge of the slats the slats will not rotate in one direction in the same manner as they rotate in the other direction. Another problem occurs when a blind having lift cords passing through the back of the slats is raised. Because the support is off center and towards the back of the blind, when the blind is drawn up it has a tendency to arch backwards with the stacked slats forming a backward J shape. Consequently, the manufacturer of this blind provides installation instruction which tell the installer to position the blinds a greater certain distance from the window to account for this arching effect. Furthermore, the slats when lifted literally hang from the lift cords. Because the bottomrail does not support the tilted stack very well, more lift cords and heavier lift cords are required. Indeed, a lift cord is needed at every ladder. Since the slats hang from the lift cords, repeated titling of the slats wears the lift cords.

Accordingly, there is a need for venetian blind which can have slats with cord holes at only one edge of the slats in order to prevent light from entering through the holes when the slats are rotated closed and prevent the slats from flipping. Such a blind should overcome the disadvantages in the prior art by closing tightly when the slats are rotated in either direction and also should maintain vertical alignment of the slats when the blind is fully raised. In this blind tilted slats should not hang on the lift cords, but be supported by the ladders and bottomrail. Then smaller diameter lift cords can be used which allows for narrower holes and better closure when the blind is tilted with the holes down.

SUMMARY OF THE INVENTION

I provide a venetian type blind having a bottomrail, headrail and plurality of slats positioned therebetween. At least two lift cords pass from the bottomrail to the headrail. The slats have at least one small hole adjacent one edge to accommodate a lift cord. One lift cord passes through each small hole. The other lift cord may pass outside the other edge of the slats so that there is a lift cord opposite the edge of the slat near the cord hole. At least two preferably cord-type ladders are provided to hold the slats. The ladders are aligned such that the rail of one ladder is adjacent each lift cord.

A tilt mechanism to close the blind is provided within the headrail which preferably moves the rails together as the tilt mechanism lifts one rail and lowers the other rail relative to one another. Therefore, the center of gravity of the blind is in the same plane throughout the tilt range. The bottomrail is tilted by the lift cords even when the blind is partially stacked so that the blind closes better in the off-side tilt when partially stacked.

A tube lift may be provided for the lift cords or a cord lock can be provided.

Other objects and advantages of the present invention will become apparent from a description of the present preferred embodiments shown in the drawings.

DESCRIPTION OF THE PREFERRED EMBODIMENTS

Figure 7:
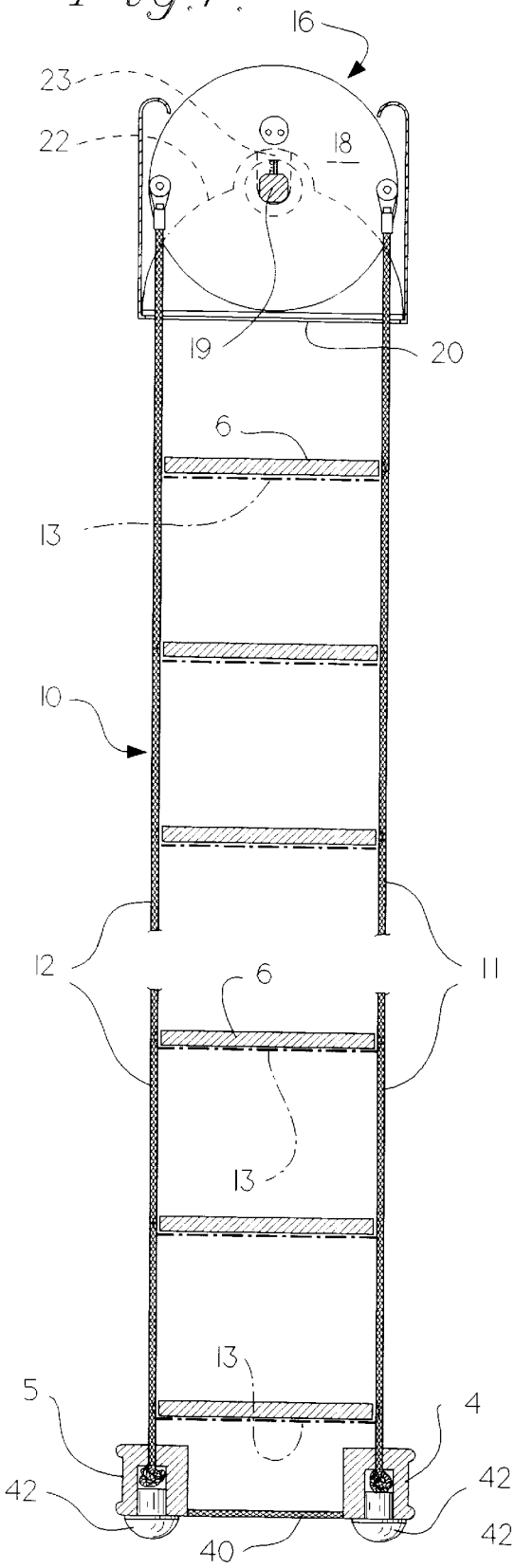
FIG. 7 is a sectional view taken along the line VII—VII in FIG. 1.
Figure 8:
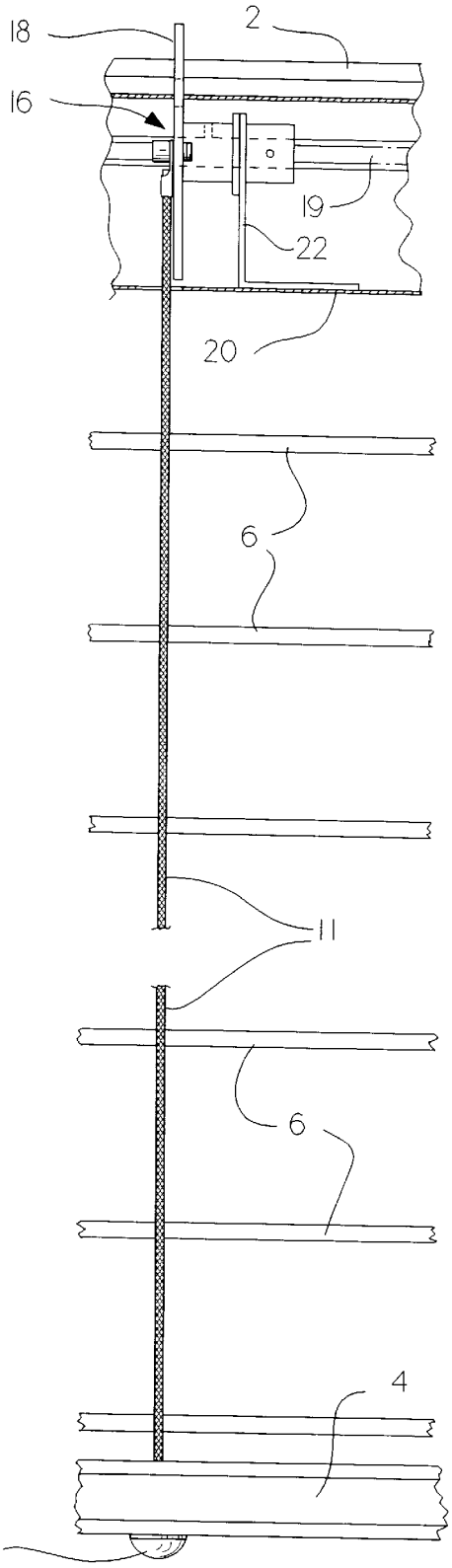
FIG. 8 is a fragmentary view showing the front portion of the blind near the line VII—VII in FIG. 1.

The first present preferred embodiment is comprised of a headrail 2, bottomrail 3 and set of slats 6 extending therebetween. A one piece or two piece bottomrail could be used. For purposes of illustration only six slats are shown. However, the blind could have any number of slats and likely would have many more slats than are shown. The slats of this embodiment are symmetrical to a horizontal plane passing through the front and back edges of the slat. Curved or crowned slats may be used in place of these flat slats if desired. Therefore, the slats are shown as crowned in some figures and flat in other figures. Wood, aluminum or plastic slats can be used. The slats are suspended on a cord type ladder 10. The ladder has a front rail 11, rear rail 12 and series of rungs 13 extending therebetween on which these slats rest. As shown most clearly in FIG. 7, the bottom ends of the ladders are knotted or otherwise connected within the bottomrails 4 and 5 and covered by plugs 42. Cord 40 is provided to tie the bottomrails 4 and 5 together and prevent them from flaring out. At least one lift cord hole 100 are provided on one edge of each slat 6, preferably the back edge, as shown most clearly in FIGS. 5 and 9. The lift cord holes 100 are sized so that lift cords 81, 82, 83 and 84, which are generally identified by reference number 8, can loosely fit therein. I prefer to make the cord holes 100 elliptical having a length of from 0.160 to 0.210 inches (4.0 mm to 5.3 mm) and a width of from 0.075 to 0. 150 inches (1.9 mm to 3.8 mm). The cord holes should be positioned so that the overlapping slat will cover the hole when the slats are fully tilted. I prefer to punch the hole 0.040 to 0.125 inches (1.0 mm to 3.2 mm) from the edge of the slat. The spacing between the slats is reduced from what is typical so the slats will overlap when closed to cover the hole.

Figure 5:
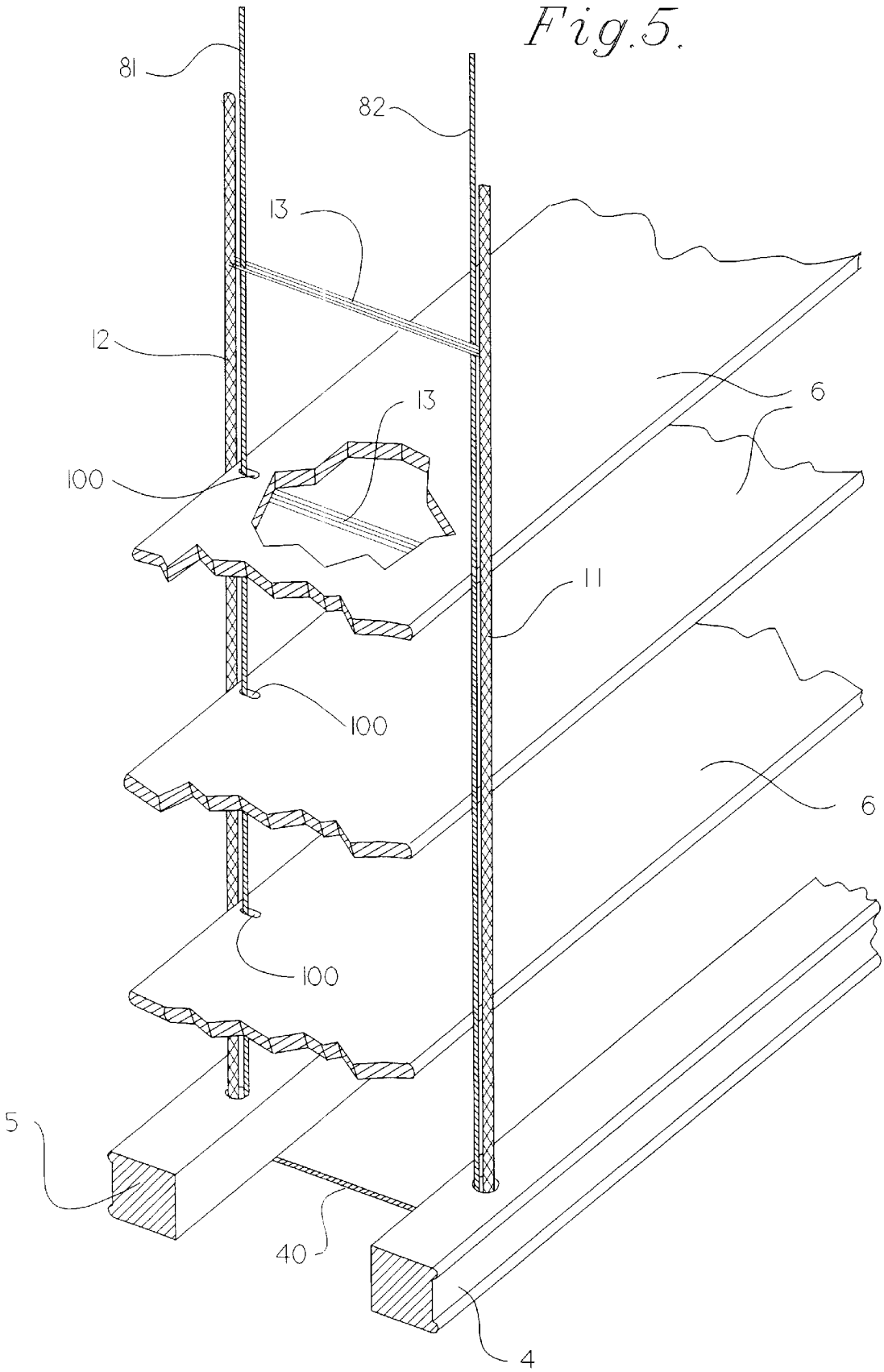
FIG. 5 is a perspective view of a portion of the embodiment shown in FIG. 1 taken around the line V—V of FIG. 1 to show the base of a pair of lift cords and adjacent ladder.
Figure 5A:
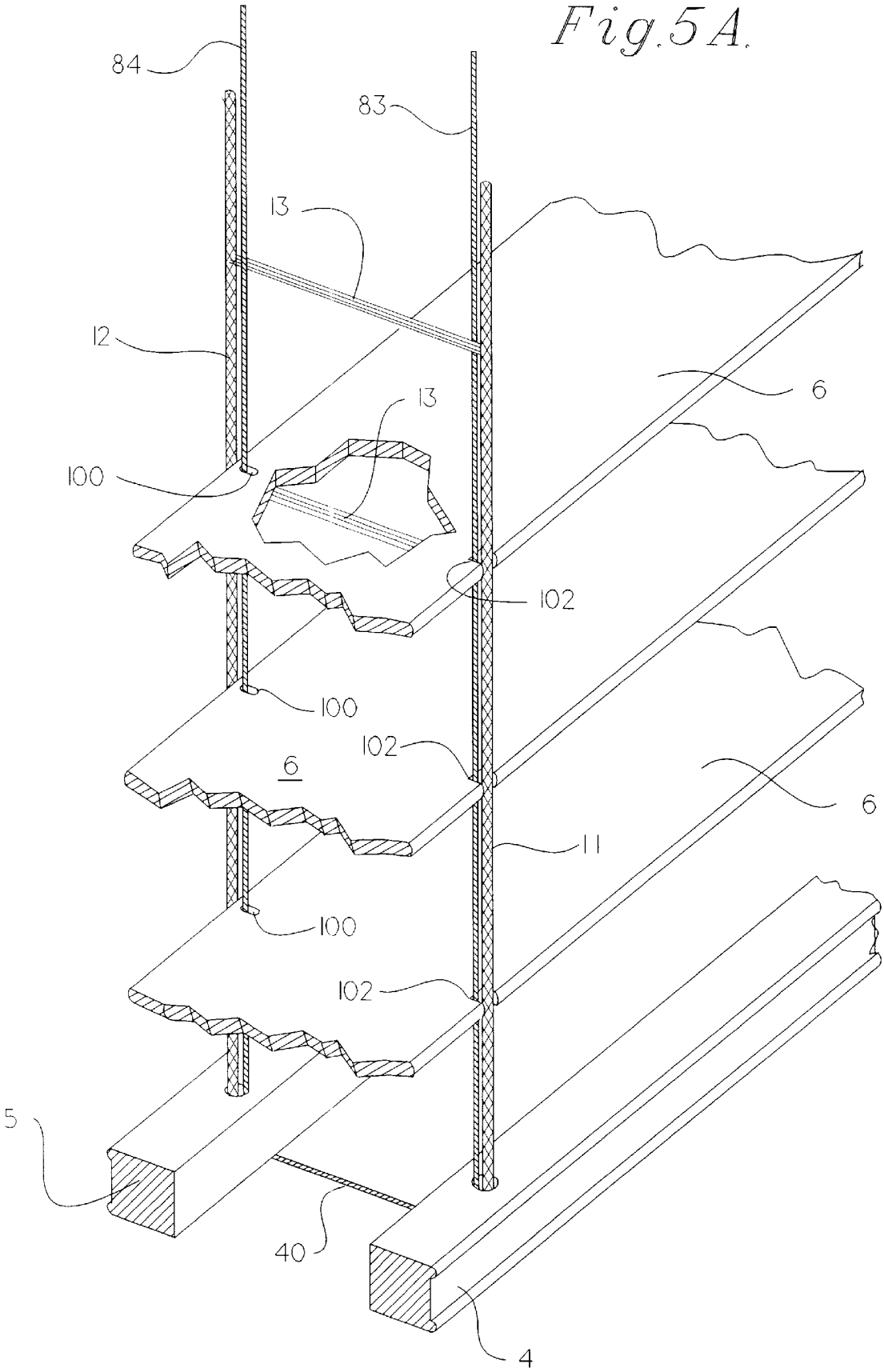
FIG. 5A is a perspective view similar to FIG. 5 showing a second preferred embodiment in which the slats have slots opposite the holes in the slats.

In an alternative embodiment, a slot 102 can be provided in the opposite edge of the slat 6 across from each lift cord hole 100, as shown in FIG. 5A. I prefer that the lift cords have a diameter smaller than the diameter of the ladder rails. I prefer to use a 0.040 inch (1.0 mm) diameter lift cord. Each slot 102 preferably has a depth such that only the lift cord 8 and a portion of the ladder and can completely fit therein. Preferably, the slot is sized so that the rail can never be fully within the slot. The slots should be sized and/or positioned so as not to overlap a hole in the adjacent slat when the slats are titled. If slats are only on ladders where there are no holes, then another concern is to adjust the ladders so that the slats are straight on the rungs.

Figure 13:
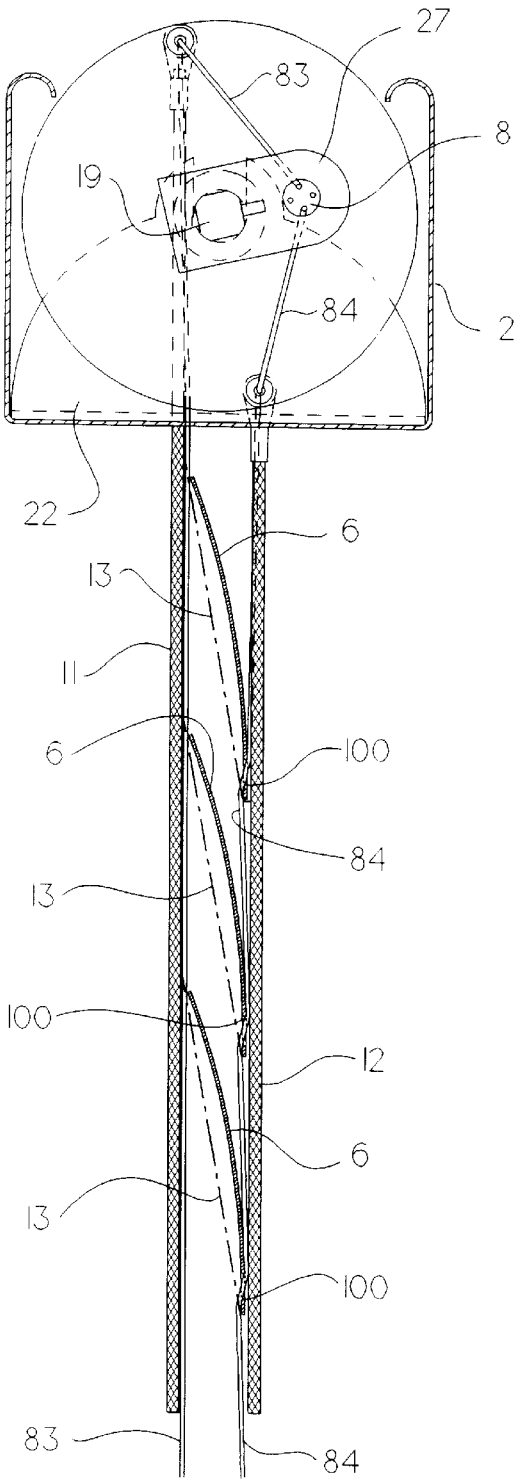
FIG. 13 is a sectional view similar to FIG. 12 showing the blind with the curved slats and in a first closed position.
Figure 14:
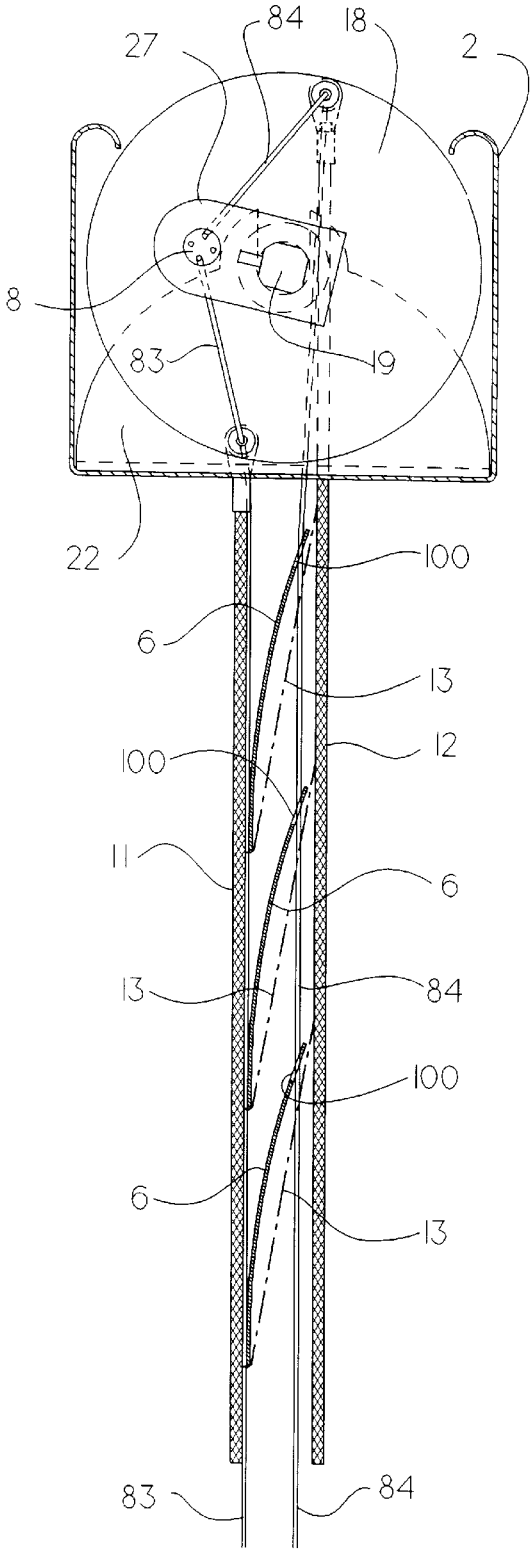
FIG. 14 is a sectional view similar to FIG. 13 showing the blind in a second closed position.

Because the lift cord holes are provided near one edge of each slat 6, when the slats 6 are rotated to a closed position shown in FIGS. 13 and 14 the slats overlap with the edge of the adjacent slat covering the lift cord holes 100 in adjacent slats 6. Additionally, since lift cords 8 are provided at both edges of the slats 6, each cord can have a smaller diameter and still provide the strength necessary to lift the blind. Also, the lift cord holes 100 in the slats 6 can be narrower and shorter allowing for less overlap which provides a lighter blind having better see through characteristics. The smaller lift cords 8 are desirable because they allow the slats 6 to be closed tighter together when rotated shut in the direction towards the lift cords, thus keeping out more light. Additionally, using a pair of lift cords 8 at each end of the blind, even though only one actually passes through a hole 100 in the slats 6, provides lift in both the front and rear edges of the slats. Consequently, there is no arching effect when the blind is being raised such as occurs in the prior art blind described previously.

In the first preferred embodiment the tilt ladders 10 are positioned near the ends of the blind so that the rails 11 and 12 are adjacent the lift cords. A third tilt ladder is provided at the center of the blind where no lift cords are needed. For purposes of illustration the lift cords 8 are shown in chain line in some of the figures so as to distinguish them from the adjacent rails of the tilt ladders or other structures.

Figures 1, 2:
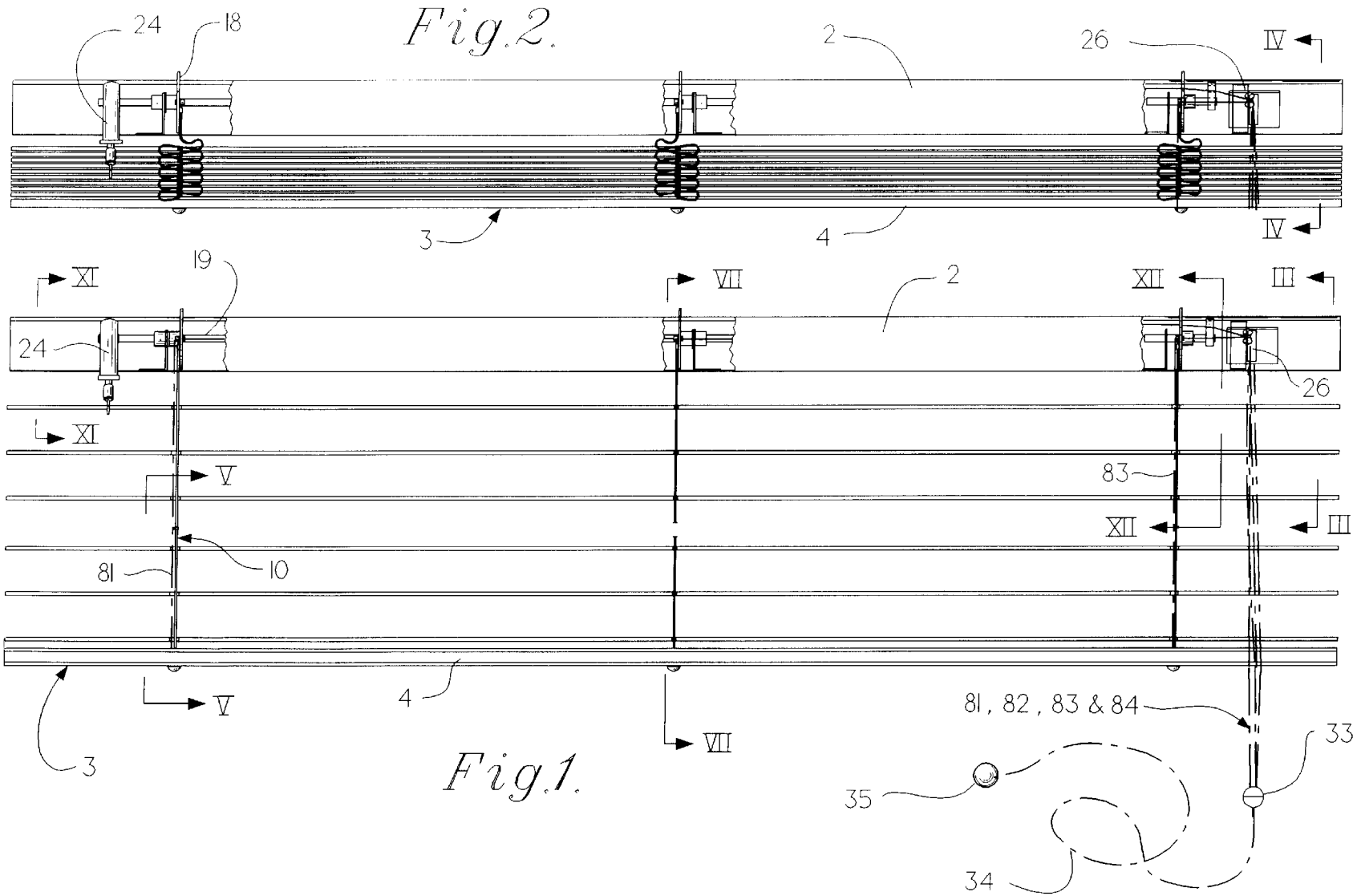
FIG. 1 is a front view of the present preferred embodiment of my venetian type blind shown in a lowered open position.
FIG. 2 is a front view similar to FIG. 1 when the blind in a raised position.

The number of lift cords that are used will vary according to the size of the blind and the cording arrangement. In every embodiment lift cords 8 should be positioned near either end of the blind. In the embodiment of FIG. 1 four lift cords extend from the bottomrail through the headrail. As shown most clearly in FIGS. 1 through 6 (but not FIG. 5A), lift cords 82 and 84 extend from the rear bottomrail 5 through lift cord holes 100 near the rear edge of slats 6. Lift cords 81 and 83 extend from the front bottomrail 4 and pass outside of the front edge of slats 6. The lift cords pass through the rungs as shown in FIG. 5 or may be laced to alternatively pass to the left and then the right of the rungs as shown in FIG. 5A. The lift cords 81, 82, 83 and 84 pass through the headrail 2 exiting on the front right side as shown in FIGS. 1 and 2. The lift cords 81, 82, 83 and 84 are threaded through the headrail over pulley 38 and into a cord lock 26 provided in the headrail 2. Support plate 36 is provided in the headrail 2 near support 37. The cords extend through the cord lock to a position outside and at one end of the blinds. Preferably, the cord lock is always engaging the lift cords unless the blind is being raised or lowered. The distal end of the lift cords may be tied together in a ball connector 33. If desired a pull cord 34 having a tassel 35 may be connected to the ball connector 33. If the bottomrail is supported by the tilt ladders, as in the embodiment of FIG. 1, the weight of the lift cords extending out of the headrail and the attached tassel can provide sufficient tension to restrain the slats from moving laterally. Moreover, a weight can be placed in the tassel 35 or connector 33 if needed. If the bottomrail is supported only by the lift cords, the weight of the bottomrail maintains the lift cords in tension. The lift cord running through holes in the slats prevents lateral motion and flipping of the slats.

Figure 9:
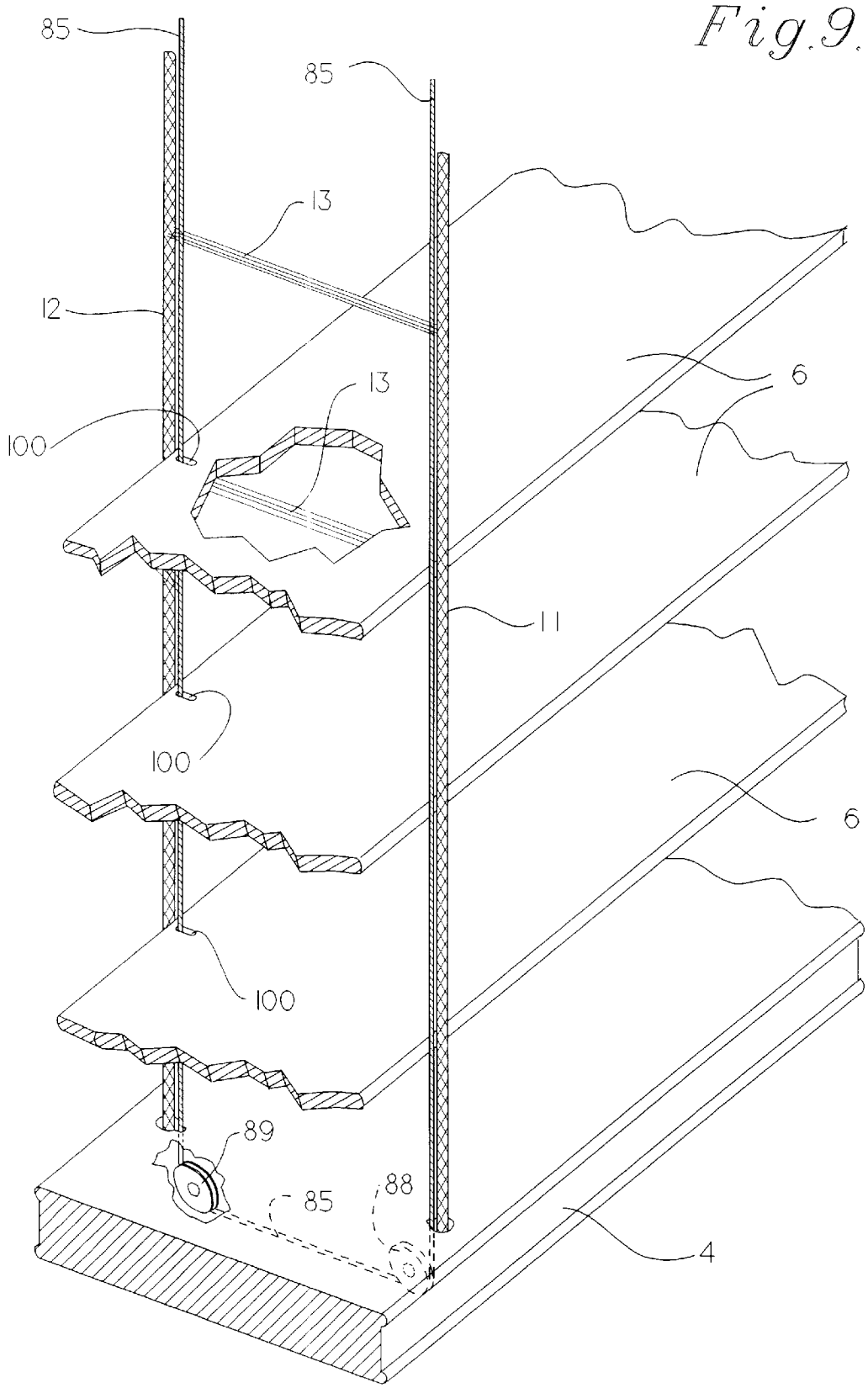
FIG. 9 is a perspective view similar to FIG. 5 showing an alternative routing for the lift cords.
Figure 10:
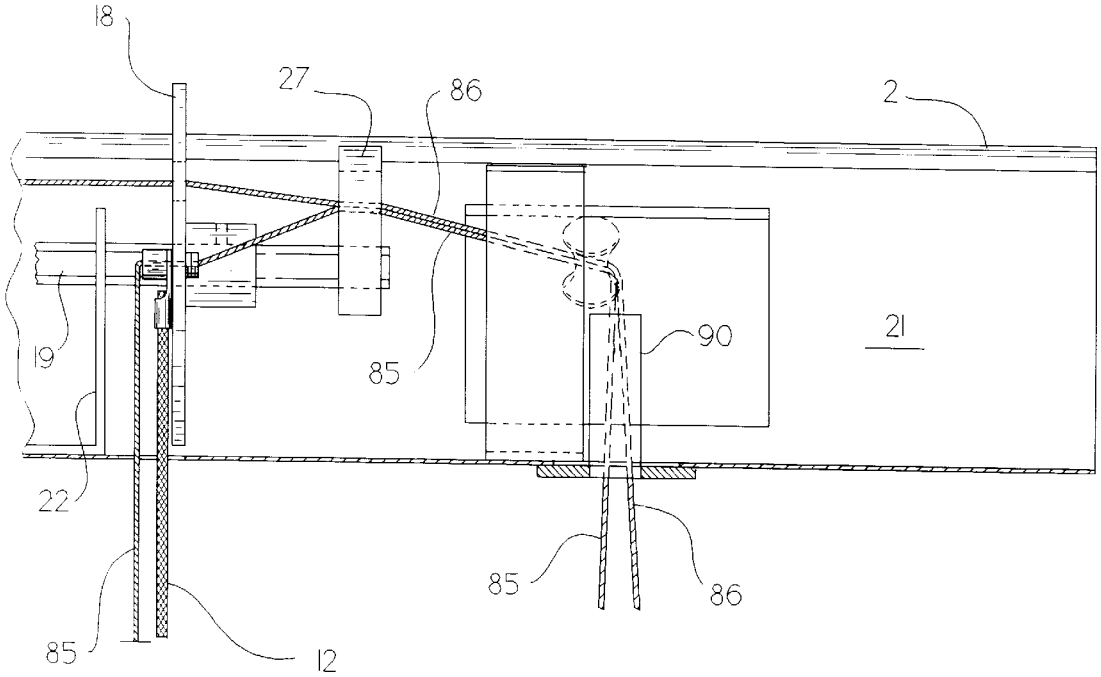
FIG. 10 is a rear view of one end of the headrail with the back panel removed to show the top portion of the alternative lift cord routing of FIG. 9.

An alternative cording arrangement shown in FIGS. 9 and 10 utilizes three lift cords and pulleys in the bottomrail 14. The distal end of each lift cord 85 and 86 is attached to the headrail via the tilt disk 18 through hole 17. (See FIG. 4) The lift cord 85 and 86 is routed from the headrail down the back of the blind thru lift cord holes 100 in the slats 6, over pulleys 88, across the single bottomrails 4, under pulley 89 and up the front of the blind adjacent the front edges and up to the headrail. The cords 85, 86 pass through a cord lock 90 and out of the headrail as shown in FIG. 10.

While the lift cords are always in tension, the rails of the tilt ladders are only in tension when the blind is fully lowered. Since the rails are on the outside edges of the slats they can fold neatly across the front of the blind when the blind is raised to the position shown in FIG. 2. Although such neat folding generally occurs, I prefer to assure that such neat folding always occurs by treating the rails with a permanent pleating or other treatment to provide a memory in the rails so that they will fold in the desired manner.

Figure 11:
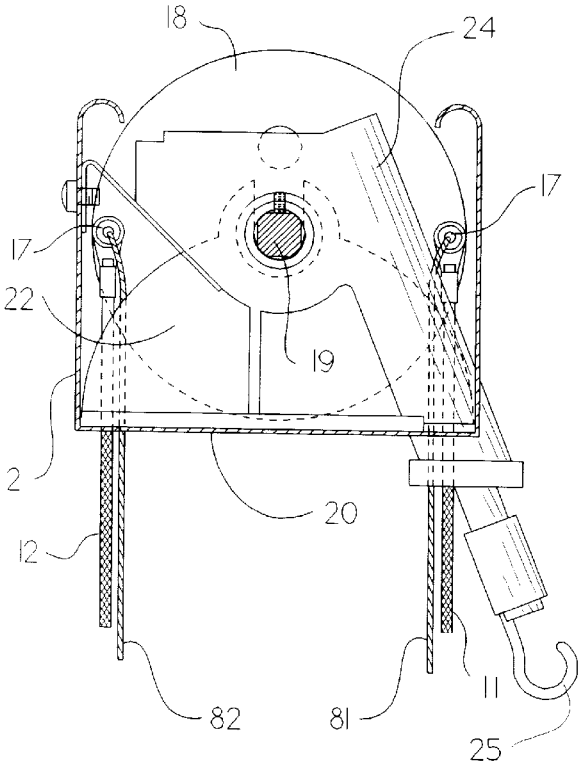
FIG. 11 is a sectional view taken along the line XI—XI of FIG. 1.
Figure 12:
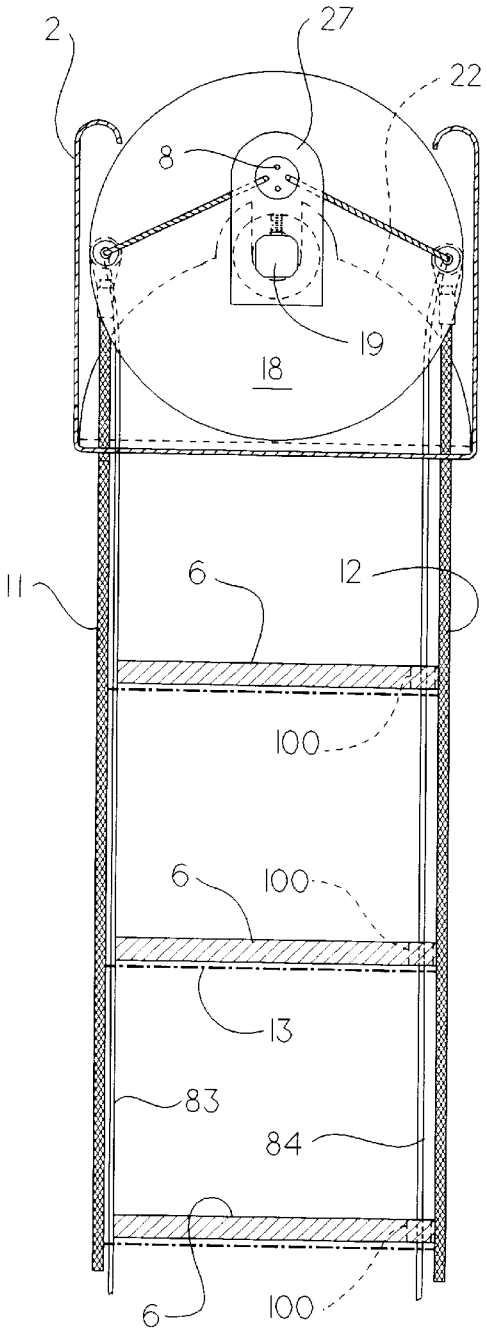
FIG. 12 is a sectional view taken along the line XII—XII of FIG. 1.

A tilt mechanism 16 is provided to move the rails 11 and 12 of the tilt ladder 10 relative to one another to open and close the blind and also moves the lift cords at the same time. The present preferred tilt mechanism can be seen most clearly by referring to FIGS. 3, 4, 7, 8, 11, 12, 13 and 14. The tilt mechanism in the preferred embodiment is comprised of a disk 18 to which the rails 11 and 12 of the tilt ladder 10 are connected. There is one disk for each tilt ladder 10. The disks 18 are mounted on tilt rod 19 so that rotation of the tilt rod will turn the disks in unison. The tilt rod is suspended above the base 20 of the headrail by cradles 22. I prefer to provide a bridge 23 on each cradle to prevent the lift cords from getting caught on the cradles. As shown in FIG. 11, a right angle drive or worm gear drive 24 is provided at one end of tilt rod 19. The drive extends through the headrail 2 to provide a handle 25 which is turned to open and close the blind. Rotation of the disk 18 in either direction lifts one rail 11 or 12 and associated lift cords relative to the other and moves the rails 11 and 12 toward one another. If a two piece bottomrail is used, the front bottomrail will move relative to the rear bottomrail. The same center of gravity should be maintained for the blind through the tilt cycle. The disks can be rotated 200 degrees. As can be seen in FIGS. 12, 13 and 14, the blind slats 6 will be in a nearly closed position after the disks 18 have been rotated in either direction through approximately 90 degrees. As disks 18 are rotated the lift cords 8 and the rails 11 and 12 of the tilt ladders 10 are constantly in tension. The lift cord passing through the holes in the slats contains the slats and prevents them from slipping laterally. When the blind is closed a position of the slat above any selected slat will overlay a portion of that slat covering the hole 100 as shown in FIGS. 13 and 14.

Figure 4:
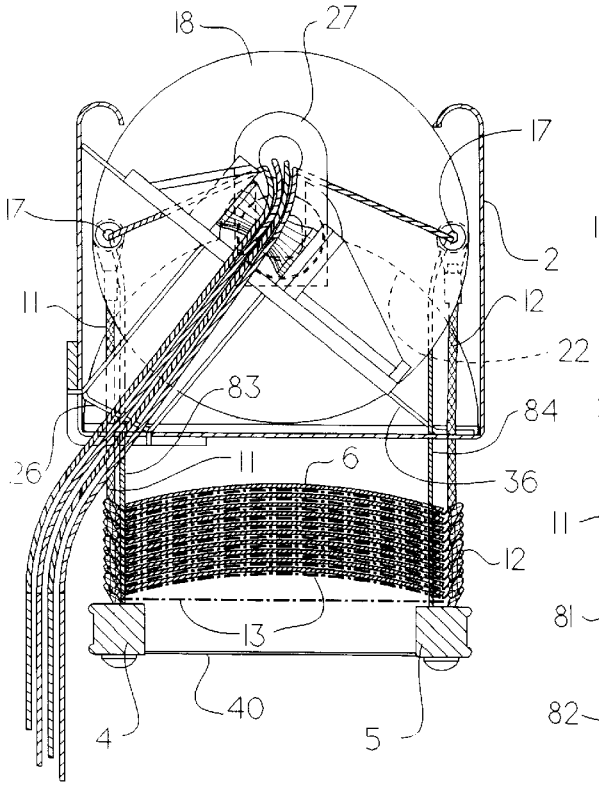
FIG. 4 is a sectional view similar to FIG. 3 taken along the line IV—IV of FIG. 2 showing the blind to have flat slats.
Figure 3:
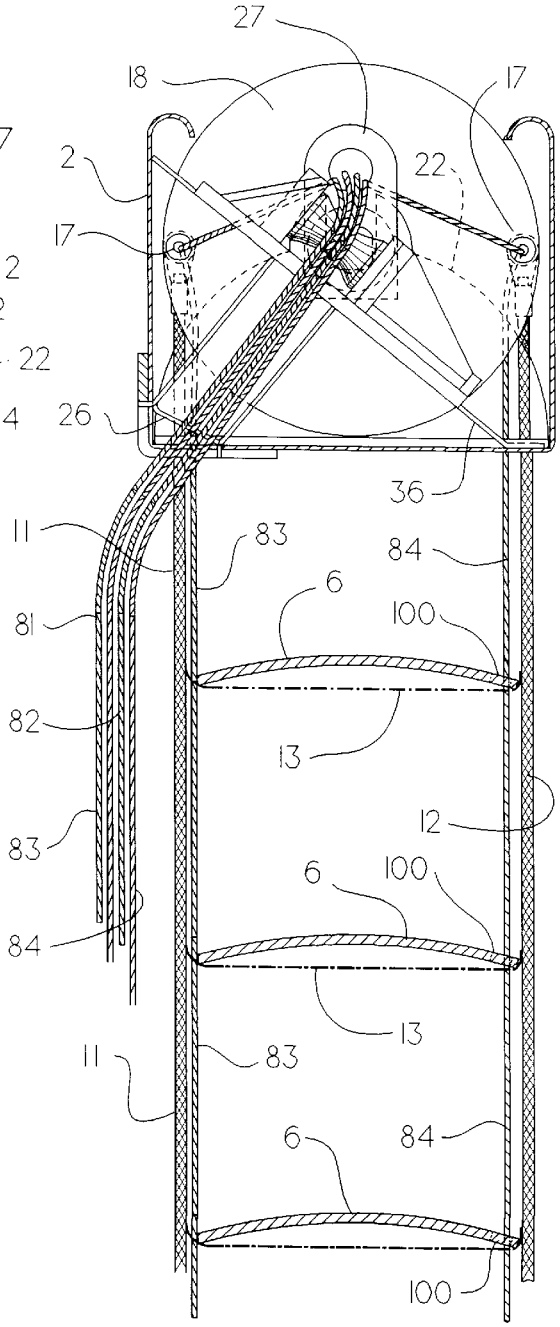
FIG. 3 is a sectional view taken along the line III—III of FIG. 1 but showing the blind to have curved slats.
Figure 6:
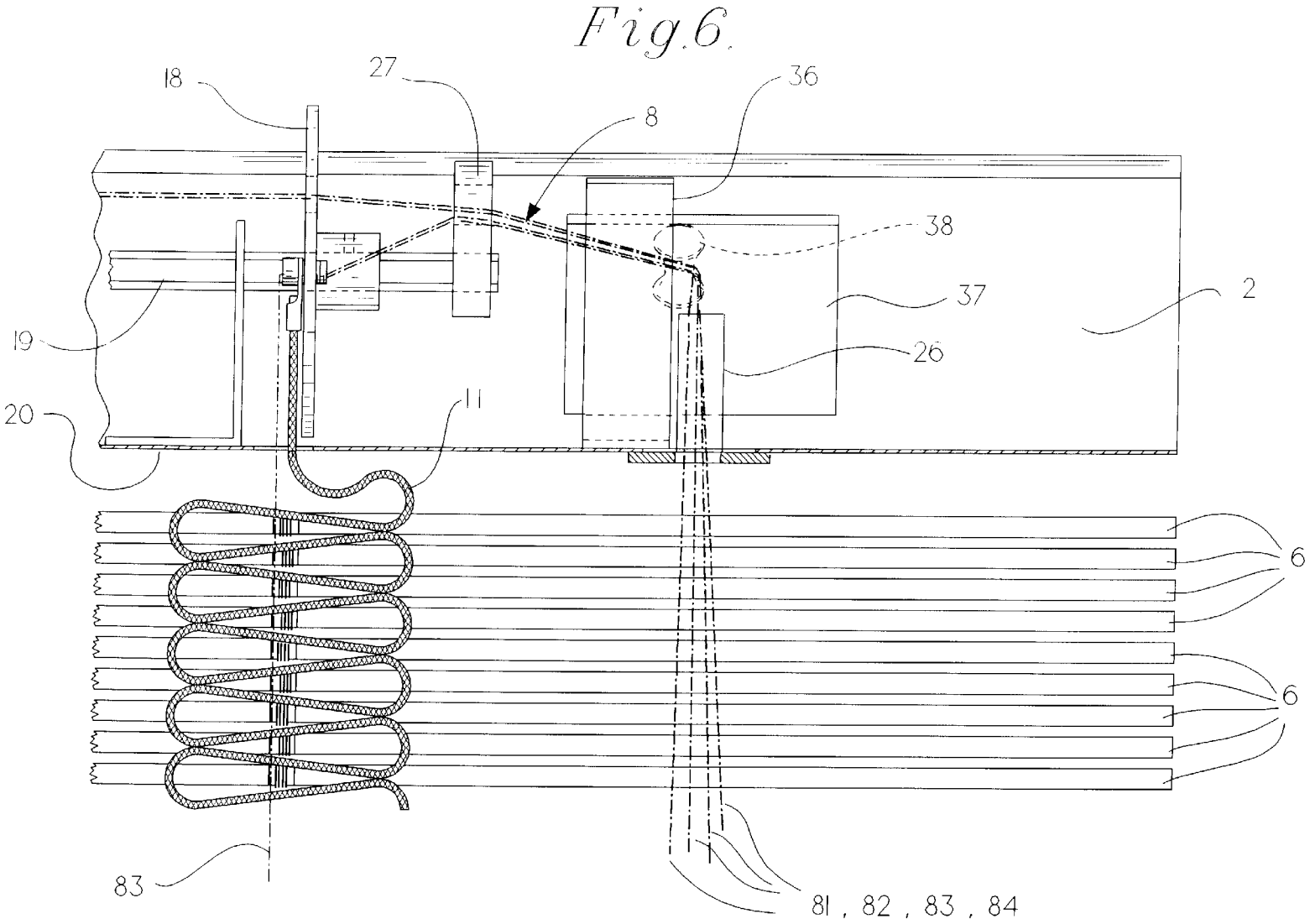
FIG. 6 is a fragmentary view showing the right end of the portion of the raised blind shown in FIG. 2 wherein the front panel of the headrail has been removed.

As can be most clearly seen in FIGS. 3, 4 and 6 the lift cords are routed through pivot holes 17 in the disks 18 located at the point of attachment of the ladder rails 11 and 12. Consequently, rotation of the disk shifts the lift cords transversely and vertically in tandem with the ladder rails and keeps the lift cords under tension. An alignment arm 27 extends from tilt rod 19 through which the lift cords pass to prevent the lift cords from getting caught on the cradles and to present the cords for a uniform entry into the cord lock independent of the tilt angle of the slats.

Figure 15:
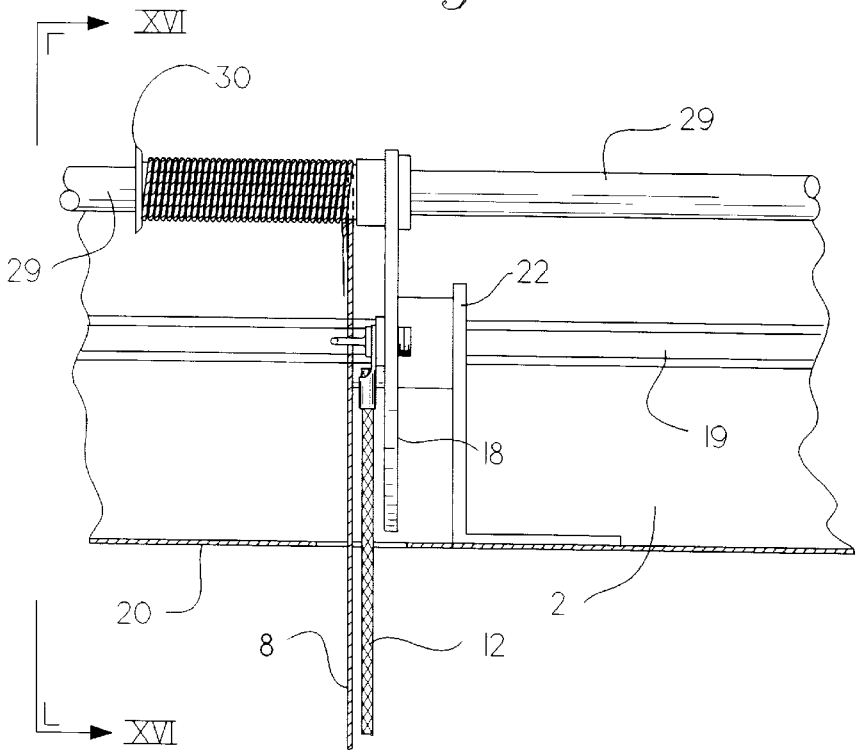
FIG. 15 is a fragmentary view similar to FIG. 6 showing a second preferred embodiment that utilizes a tube lift.
Figure 16:
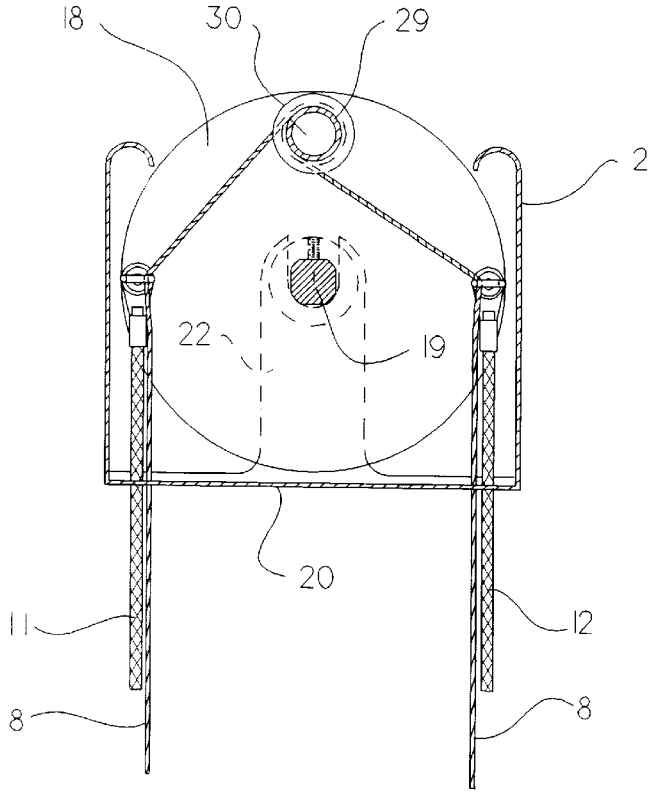
FIG. 16 is a sectional view taken along the line XV—XV of FIG. 15.

In the first preferred embodiment the lift cords 8 pass through the headrail. An alternative is shown in FIGS. 15 and 16 wherein the lift cords are wound about a tubular drive mechanism 30. The drive mechanism includes an axle 29 around which the lift cords 8 are wound. Winding is done such that the lift cord extending from the front is wound in one direction while the lift cord extending from the rear is wound in the same direction from the opposite side as shown in FIG. 15. Thus, turning of the drive axle 29 will raise or lower the lift cords in the front and back at the same time without affecting the tilt of the blind. A tube lift mechanism such as is disclosed in U.S. Pat. No. 5,184,660 can be adopted for the venetian blind shown in FIGS. 15 and 16.

There are many hardware systems by which the lift cords can be tilted in tandem with the rails of the tilt ladder 10. For example, a set of horizontal disks can be combined with straps or cables and cord locks to form a parallelogram that moves in tandem with the tilt ladder. In another possible arrangement, the disks could be combined with a tilting bar or rotating beam.

In the embodiment of FIG. 1 four lift cords extend from the bottomrail through the headrail. As shown most clearly in FIGS. 1 through 6 (but not FIG. 5A), lift cords 81 and 83 extend from the bottomrail 3 and pass across the front edge of slats 6. Lift cords 82 and 84 extend from the bottomrail 3 and pass through holes 100 in the rear edge of slats 6. The lift cords 81, 82, 83 and 84 pass through the headrail 2 exiting on the front right side as shown in FIGS. 1 and 2.

Figure 17:
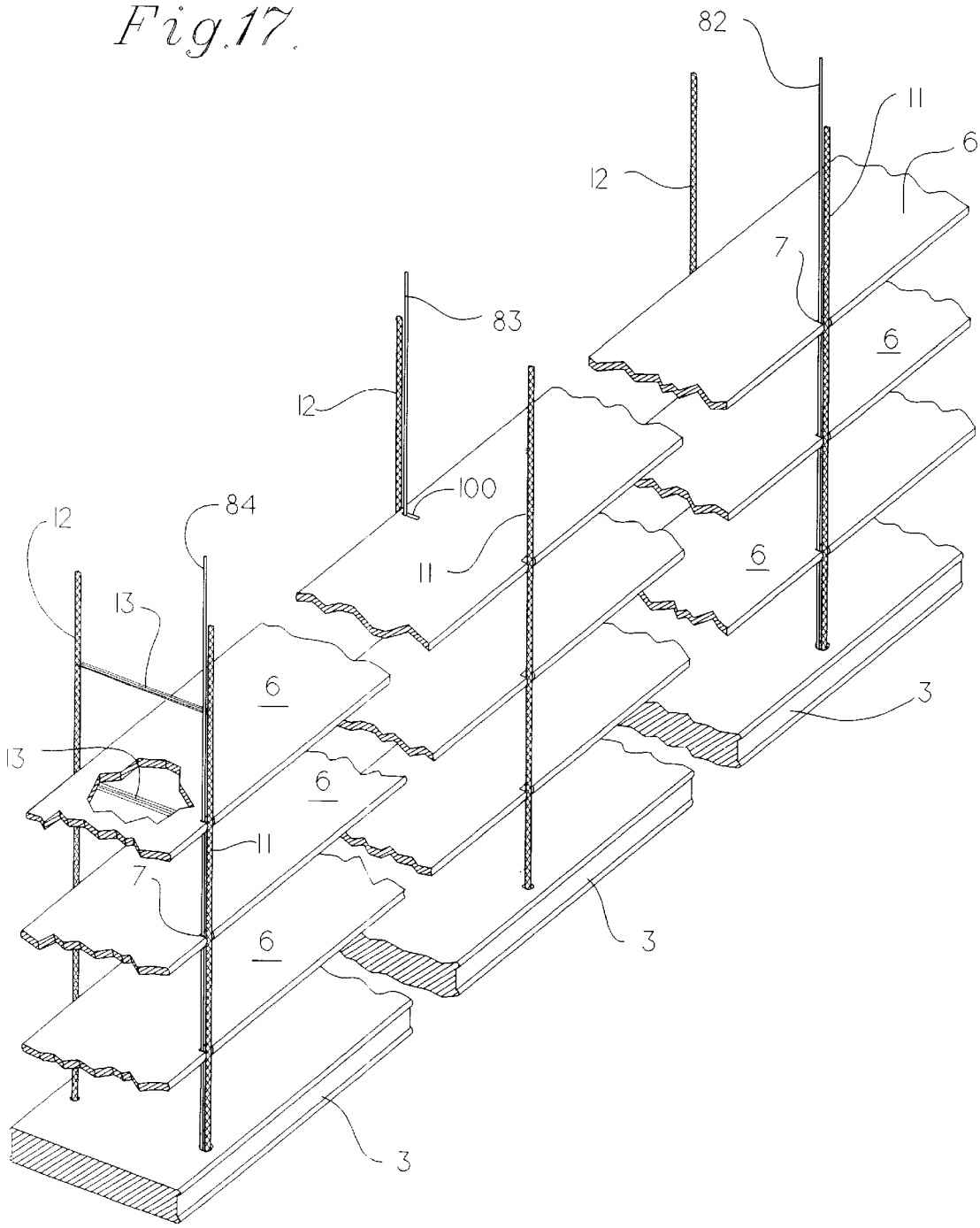
FIG. 17 is a perspective view similar to FIG. 5 showing another alternative routing for the lift cords.

Another present preferred embodiment shown in FIG. 17 has three lift cords 82, 83 and 84. Lift cord 83 passes through elongated hole 100 near the rear edge of the slat 6. Lift cords 82 and 84 run through slots 7 cut in the front edge of the slats. It should be noted that in this embodiment a slot is cut near each front ladder rail even though a lift cord is not present. This assures that the slats will all ride the same on all ladder rungs and be equally spaced from adjacent ladders throughout their length. Alternatively, slats 7 can be eliminated and lift cords 82 and 84 will run across the front edge of the slats. From FIG. 17 it should be apparent that for smaller blinds having only two ladders, only two lift cords can be used. One lift cord would be positioned as is lift cord 84, the second lift cord would be located like lift cord 83 and the segment of the blind near lift cord 82 would be eliminated.

Figure 18:
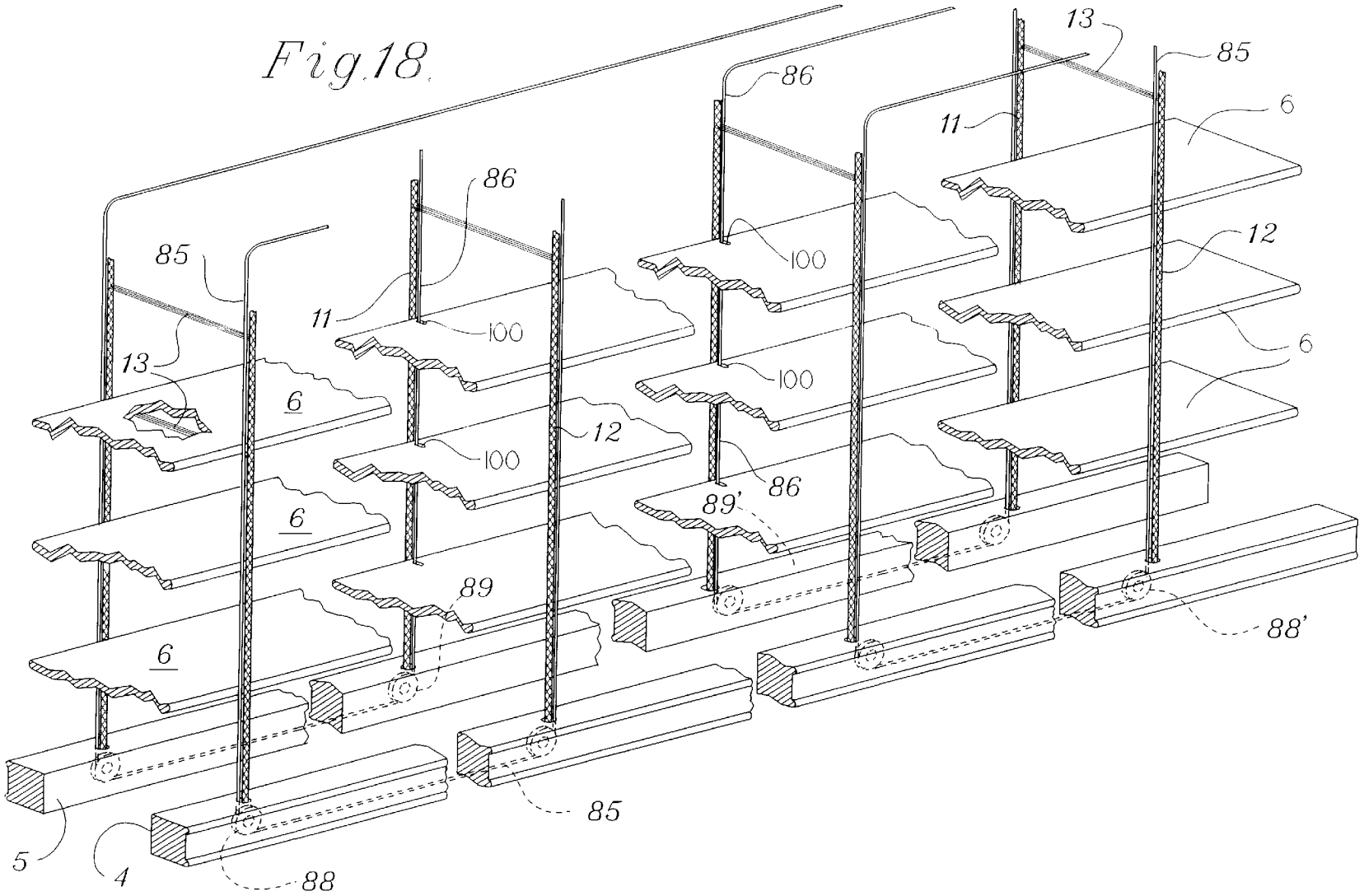
FIG. 18 is a perspective view similar to FIG. 5 showing yet another alternative routing for the lift cords.

Another alternative cording arrangement shown in FIG. 18 utilizes two lift cords and pulleys in a two piece bottomrail 4 and 5. The distal end of each lift cord 85 and 86 is attached to the disk 18 thru hole 17. Although not shown in the drawings I prefer to make the attachment to a tilt disk or cord guide 27 at the end of the headrail opposite the cord lock this assures that all the cords are the same length. One lift cord 85 is routed from the headrail down the front of the blind over pulleys 88, along the front bottomrail 4, under second pulley 88' and up the front of the blind to the headrail. Similarly, lift cord 86 is routed from the headrail through the holes 100, over pulley 89, along the rear bottomrail 5, under second pulley 89' and up through a hole 100' to the headrail. The cords 85, 86 pass through a cord lock and out of the headrail as in the embodiment shown in FIG. 1. So that cords 85 and 86 are closer in length, cord 86 may run from the headrail through holes adjacent the first ladder, through the bottomrail, and up through holes adjacent the third ladder while lift cord 85 runs adjacent the second and fourth ladder. If desired, a single cord could be used at the rear of the blind and the pulley system shown in FIG. 18 could be used in the front of the blind or vice versa. One could also provide a pulley arrangement in which each cord goes up and down in the same set of slots. Yet another arrangement would affix one lift cord at the disk away from the cord lock and route it down the front of the blind through a single bottomrail to the other end of that bottomrail, up through holes near the back of the blind, and through a cord lock at the other end of the headrail. A second lift cord would follow a similar pattern passing through a different set of slots.

Although I have shown and described certain present preferred embodiments of my venetian blind it should be distinctly understood that the invention is not limited thereto but may be variously embodied within the scope of the following claims.

I claim:

1. A venetian type blind comprising:

a bottomrail;

a plurality of slats above the bottomrail, each slat having a first edge and a second edge parallel to the first edge and a hole near the first edge so that each hole is at least partially obscured by an adjacent slat when the slats are in at least one of two closed positions;

a first ladder connected to the bottomrail and having opposite rails and rungs extending therebetween, one rail of the first ladder positioned adjacent the first edge near the hole in each slat and the second rail positioned adjacent the second edge of the slats;

a first lift cord connected to the bottomrail, the first lift cord running through the hole in each slat;

a second ladder connected to the bottomrail and having opposite rails and rungs extending therebetween, one rail of the second ladder positioned adjacent the first edge and the second rail positioned adjacent the second edge of the slats;

at least one second lift cord connected to the bottomrail and running adjacent the second edge of the slats and adjacent the second rail of one of the ladders the second lift cord being engaged with at least some of the rungs of that ladder;

a headrail above the bottomrail and the plurality of slats through which the lift cords pass; and a tilt mechanism attached to the headrail and to which the first and second ladders are attached.

2. The venetian type blind of claim 1 wherein the tilt mechanism moves rails of the ladders together when the blind is changed from an open position to a closed position.

3. The venetian blind of claim 1 wherein the slats have a pair of holes near the first edge and a pair of laterally spaced apart slots on the second edge, each slot provided across from each hole, and a lift cord running through each slot.

4. The venetian type blind of claim 3 wherein each slot has a depth substantially equal to a diameter of the lift cords.

5. The venetian blind of claim 1 wherein the cords are each alternately laced with the rungs of one of the ladders.

6. The venetian blind of claim 1 wherein at least one of the lift cords passes through at least one rung of one of the ladders.

7. The venetian type blind of claim 1 wherein the lift cords have a diameter smaller than a diameter of the rails of the first and second ladders.

8. The venetian type blind of claim 1 wherein the tilt mechanism is comprised of:

a first disk to which the rails of the first ladder are attached;

a second disk to which the rails of the second ladder are attached;

an axle attached between the first disk and the second disk; and means for rotating the axle and attached disks.

9. The venetian type blind of claim 8, wherein at least one of the lift cords passes through at least one of the first disk and the second disk.

10. The venetian type blind of claim 8 wherein the means for rotating the axle and attached disks is one of a right angle drive and a worm drive.

11. The venetian type blind of claim 1 wherein the slats are symmetrical to a plane passing from the front edge to the back edge of the slats.

12. The venetian type blind of claim 1 wherein the slats are one of wood, aluminum and plastic.

13. The venetian type blind of claim 1 also comprising a tube lift attached to the headrail and to which the lift cords are connected.

14. The venetian type blind of claim 1 also comprising four pulleys within the bottomrail and positioned so that one lift cord passes over each pulley.

15. The venetian type blind of claim 1 also comprising at least one weight attached to at least one lift cord.

16. The venetian type blind of claim 1 also comprising a cord lock through which the lift cords pass.

17. The venetian type blind of claim 16 wherein the cord lock is always engaged unless the lift cords are being operated.

18. The venetian type blind of claim 1 wherein the second lift cord passes through at least some of the rungs.

19. The venetian type blind of claim 1 wherein the second lift cord is alternately laced with at least some of the rungs.

20. A venetian type blind comprising:

a bottomrail comprised of two spaced apart parallel rails;

a plurality of slats above the bottomrail, each slat having a first edge and a second edge parallel to the first edge and a hole near the first edge so that each hole is at least partially obscured by an adjacent slat when the slats are in at least one of two closed positions;

a first ladder connected to the bottomrail and having opposite rails and rungs extending therebetween, one rail of the first ladder positioned adjacent the first edge near the hole in each slat and the second rail positioned adjacent the second edge of the slats;

a first lift cord connected to one rail of the bottomrail, the first lift cord running through the hole in each slat;

a second ladder connected to the bottomrail and having opposite rails and rungs extending therebetween one rail of the second ladder positioned adjacent the first edge and the second rail positioned adjacent the second edge of the slats;

at least one second lift cord connected to the other rail of the bottomrail and running adjacent the second edge of the slats and adjacent the second rail of one of the ladders;

a headrail above the bottomrail and the plurality of slats through which the lift cords pass; and a tilt mechanism attached to the headrail and to which the first and second ladders are attached.

21. A venetian type blind comprising:

a bottomrail;

a headrail above the bottomrail;

a plurality of slats between the headrail and the bottomrail, each slat having a first edge and a second edge parallel to the first edge and a hole near the first edge so that each hole is at least partially obscured by an adjacent slat when the slats are in at least one of two closed positions;

a first ladder having opposite rails and rungs extending therebetween, the first ladder carrying the slats, positioned near the hole in each slat and connected to the bottomrail;

a first lift cord running through the hole in each slat and adjacent the first ladder, there being no other lift cord adjacent the first ladder;

a second ladder having opposite rails and rungs extending therebetween, the second ladder carrying the slats, spaced apart from the first ladder and connected to the bottomrail;

a third ladder having opposite rails and rungs extending therebetween, the third ladder carrying the slats, spaced apart from the first ladder and connected to the bottomrail;

a second lift cord passing from the headrail along the second edge of the slats adjacent to one rail of the second ladder and engaging at least some of the rungs of the second ladder, through the bottomrail along the second edge of the slats adjacent one rail of the third ladder and engaging at least some of the rungs of the third ladder, and into the headrail; and a tilt mechanism attached to the headrail to which tilt mechanism at least the first, second and third ladders are attached.

22. The venetian blind of claim 21 also comprising a fourth ladder carrying the slats and wherein there is a second hole in each slat and the second lift cord runs through the bottom rail and through the second hole in each slat.

23. The venetian blind of claim 21 wherein each slat has a pair of spaced apart hole through which the second lift cord runs.

24. The venetian blind of claim 21 wherein at least one of the lift cords passes through at least one rung of one of the ladders.

25. The venetian blind of claim 21 wherein the tilt mechanism moves rails of the ladders together when the blind is changed from an open position to a closed position.

26. The venetian type blind of claim 21 wherein the lift cords have a diameter smaller than a diameter of the rails of the ladders.

27. The venetian type blind of claim 21 also comprising a tube lift attached to the headrail and to which the lift cords are connected.

* * * * *